US008215279B2

(12) United States Patent
Ziegs

(10) Patent No.: US 8,215,279 B2
(45) Date of Patent: Jul. 10, 2012

(54) STARTING DEVICE FOR COMBUSTION ENGINE

(75) Inventor: Carsten Ziegs, Hamburg (DE)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 12/861,143

(22) Filed: Aug. 23, 2010

(65) Prior Publication Data

US 2011/0048360 A1 Mar. 3, 2011

(30) Foreign Application Priority Data

Aug. 25, 2009 (DE) ..... 20 2009 011 429 U
Aug. 25, 2009 (DE) ..... 20 2009 011 430 U

(51) Int. Cl.
*F02N 3/02* (2006.01)

(52) U.S. Cl. ..... 123/185.3

(58) Field of Classification Search ..... 123/185.3
See application file for complete search history.

(56) References Cited

U.S. PATENT DOCUMENTS

| | | | | |
|---|---|---|---|---|
| 4,480,605 | A * | 11/1984 | Bloemers | 123/185.3 |
| 7,174,874 | B2 * | 2/2007 | Horikoshi | 123/185.3 |
| 7,213,561 | B2 | 5/2007 | Hasiba | |
| 2001/0047786 | A1 * | 12/2001 | Kawasaki et al. | 123/185.3 |
| 2002/0174848 | A1 * | 11/2002 | Nieda et al. | 123/185.14 |
| 2003/0094154 | A1 * | 5/2003 | Morishige et al. | 123/185.3 |
| 2003/0213455 | A1 * | 11/2003 | Tohyama | 123/185.3 |
| 2004/0079313 | A1 * | 4/2004 | Tsunoda et al. | 123/185.3 |
| 2004/0123827 | A1 * | 7/2004 | Tsunoda et al. | 123/185.3 |
| 2004/0250786 | A1 * | 12/2004 | Kruse et al. | 123/185.3 |
| 2005/0252477 | A1 * | 11/2005 | Schriever et al. | 123/185.14 |
| 2006/0070596 | A1 * | 4/2006 | Horikoshi | 123/185.3 |
| 2006/0231055 | A1 * | 10/2006 | Dahlberg | 123/185.3 |
| 2010/0132650 | A1 * | 6/2010 | Eakins, Jr. | 123/185.3 |

FOREIGN PATENT DOCUMENTS

DE 41 35 405 A1 4/1993

OTHER PUBLICATIONS

German Search Report dated Aug. 2, 2010 in German Patent Application No. 20 2009 011 429.5 (with translation).

* cited by examiner

*Primary Examiner* — Stephen K Cronin
*Assistant Examiner* — Arnold Castro
(74) *Attorney, Agent, or Firm* — Oliff & Berridge, PLC

(57) ABSTRACT

In order to design a starting device for at least one combustion engine, more preferably cable-operated starting device for at least one two-stroke or four-stroke engine with at least one cable disc or cable drum rotatably mounted in a housing, which for generating a drive rotational moment for an engine shaft can be rotated by means of at least one starting handle or pulling handle, via at least one force transmission means, more preferably via a starting cable or pulling cable and which is connected via at least one elastic coupling link with at least one driver link, more preferably with at least one pawl driver, by means of which the drive rotational moment can be transmitted onto the engine shaft, the coupling link has two ends, wherein an end is engaged with the driver link, as light as possible through direct operational connection of force transmission means and elastic link/coupling link it is proposed that another end of the coupling link is engaged with the cable disc or the cable drum and the force transmission means.

8 Claims, 4 Drawing Sheets

STARTING DEVICE FOR COMBUSTION ENGINE

Figure 1:
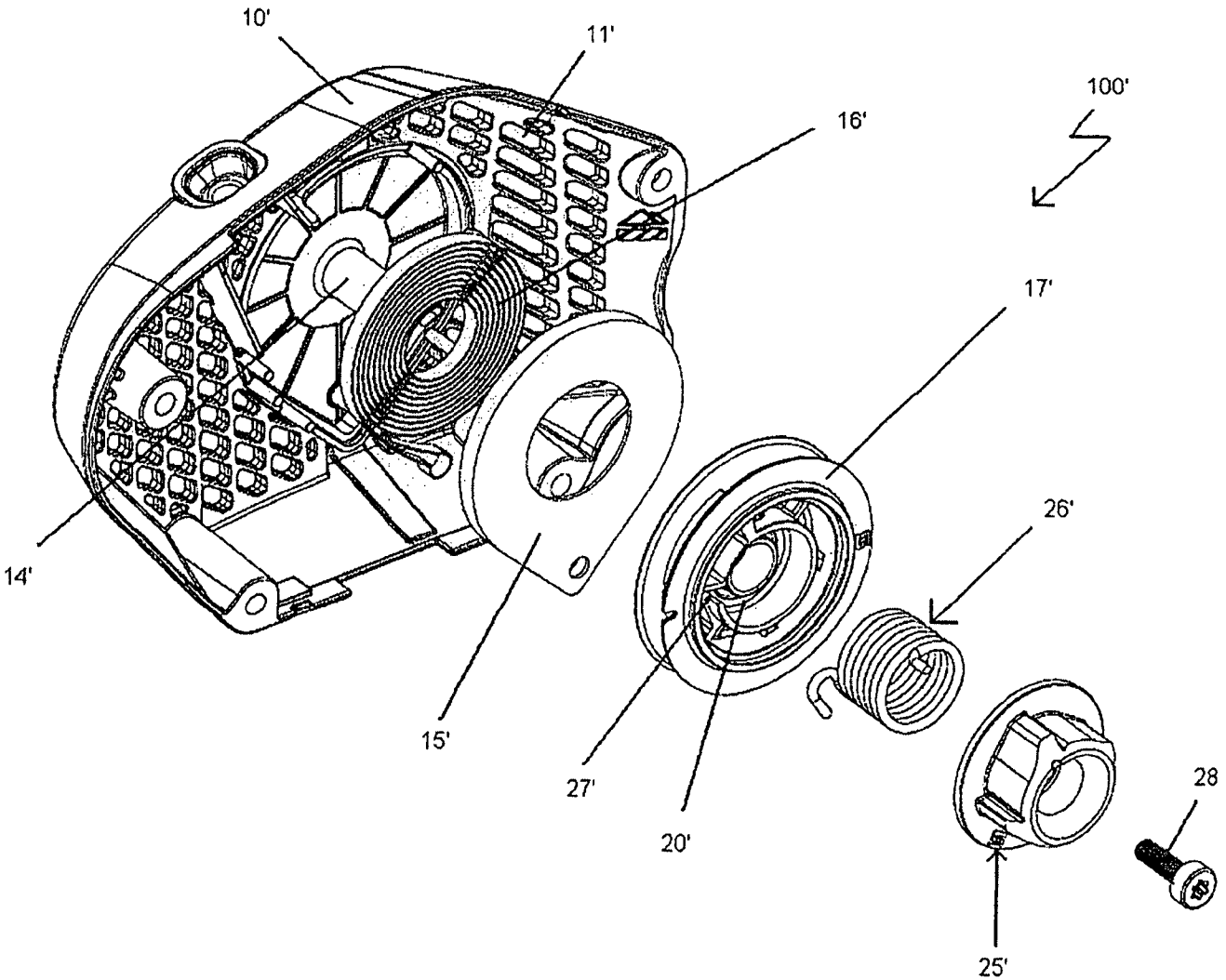
Fig. 1 PRIOR ART

The invention relates to a starting device for at least one combustion engine, more preferably cable-operated starting device for at least one two-stroke or four-stroke engine with at least one cable disc or cable drum rotatably mounted in a housing which for generating a drive rotational moment for an engine shaft can be rotated by means of at least one starter handle or pulling handle, via at least one force transmission means, more preferably via a starter cable or pulling cable and via at least one elastic coupling link is connected with at least one driver link, more preferably with at least one pawl driver, by means of which the drive rotational moment can be transmitted on to the engine shaft, the coupling link has two ends, wherein an end is engaged with the driver link.

Operating a starting device for a combustion engine, more preferably a cable-operated starting device for a combustion engine, more preferably for a two-stroke or four-stroke engine often presented problems in the past since during starting high reaction forces occur periodically through the compression in the combustion engine, as a result of which changing and temporarily very high forces act on the hand of the operating person.

In order to reduce the transmission of these particularly strong reaction forces on to the handle of the starting device caused by the compression in the combustion engine and to facilitate the starting operation as a result, it is proposed for example in DE 41 35 405 to elastically cushion the fluctuations of the rotational moment to be applied to the engine shaft.

To this end, an elastic link is connected between the cable disc or cable drum associated with the force transmission means, more preferably the starter cable or pulling cable of the handle and the driving link more preferably the pawl driver of the crankshaft, by means of which the pulling movement imparted through the handle and force transmission means during the starting operation is somewhat or completely freed of the fluctuations explained above.

With a starting device of this type known from the prior art the spring force of the coupling element acts on the coupling element of the cable disc or cable drum so that the construction of the latter has to be robust and thus heavy.

The invention is based on the object of configuring a starting device of the type mentioned at the outset as light as possible through direct operational connection of force transmission means and elastic link/coupling link.

This object is solved through the feature combination of a starting device for at least one combustion engine, more preferably cable-operated starting device for at least one two-stroke or four-stroke engine, with at least one cable disc or cable drum rotatably mounted in a housing, which for generating a drive rotational moment for an engine shaft can be rotated by means of at least one starting handle or pulling handle via at least one force transmission means, more preferably via a starting cable or pulling cable and via at least one elastic coupling link is connected with at least one driver link, more preferably with at least one pawl driver, by means of which the drive rotational moment can be transmitted to the engine shaft, the coupling link has two ends, wherein an end is engaged with the driver link, characterized in that another end of the coupling link is engaged with the cable disc or the cable drum and the force transmission means.

With a starting device of this type according to the invention it has proved to be extremely advantageous that the coupling element acts directly on the force transmission means in the cable disc or the cable drum and thus the material loading in the cable disc or the cable drum is greatly reduced. Through such an arrangement, light-weight construction of the cable reel is possible, as a result of which the entire starting device becomes lighter. Since such starting devices are frequently used in applications such as power chain saws which already have a not inconsiderable weight anyhow, any weight saving is therefore desirable. Advantageous configurations of the invention are characterized in the subclaims.

According to a preferred embodiment of the starting device according to the invention the feature of the end of the coupling element engaged with the cable disc or the cable drum and the force transmission means is provided in the starting device in such a manner that the force transmission means is passed through the cable disc or the cable drum and linked to the coupling link. Here, the coupling element should be embodied so that the force transmission means such as for example a pulling cable can be attached thereto.

According to a further preferred embodiment of the invention the starting device is provided in such a manner that the coupling link comprises a three dimensional spring wound from wire whose first winding facing the cable disc or cable drum has a smaller cross-sectional area than a following winding.

Even in the prior art a proposal was developed wherein the elastic coupling link embodied as coil spring in starting operation is twisted by an angle of twist of approximately 270° to approximately 280°, as a result of which good starting characteristics of the combustion engine are obtained. On reaching this maximum angle of twist the coil spring partially comes to bear against the shaft as a result of its reduction connected with the twisting. This coming to bear of the coil spring against the shaft blocks further twisting so that the driver link of the crankshaft ultimately co-rotates positively with the cable disc or cable drum. By means of this, different spring characteristics can be set.

In DE 203 01 182 U1 it was proposed that the angle of twist by which the driver link can be twisted with respect to the cable disc or cable drum subject to the loading of the elastic coupling link can be limited to a defined maximum angular value, as a result of which the maximum loading of the coupling element can be predetermined. This can for example be accomplished through a stop.

From DE 203 19 902 U1 it is additionally known to provide at least one thin-walled bush or sleeve in the intermediate space between the cable disc or cable drum, more preferably of the axle of the cable disc or cable drum and the coupling link or the driver link, more preferably the axle of the driver link, by means of which this intermediate space can be filled at least partially.

With all these configurations of the coupling element known from the prior art additional components or component elements in the starting device are required which result in additional expenditure.

According to the described preferred embodiment of the invention with a starting device the coupling link, which comprises a three-dimensional spring wound from wire, will be provided in such a manner that its first winding facing the cable disc or cable drum has a smaller cross-sectional area than a following winding. This increases the lifespan of the spring. As a result of this, deformations are minimised, i.e. the region of the spring susceptible to breakage is unloaded.

Cross-sectional area here means an area enclosed by a winding.

With a configuration of the starting device according to the invention it is now possible that from a certain load intensity upon loading of the spring said spring first comes to bear against the bearing pin of the starter housing.

Through this configuration breakage of the spring which usually occurs at this point during overloading can be prevented since the first smaller spring winding comes to bear against the bearing pin of the housing.

Thus it is possible, through such a modified configuration of the coupling link according to the invention, to prevent overloading of the coupling element without further component modifications.

According to a preferred configuration of the present invention the cross-sectional areas of the spring substantially diminish from the second winding facing the cable disc or cable drum towards the end facing the driver link.

With a configuration of the coupling element of this type its tapering shape follows the inflowing cooling air flow of the ventilation elements of the housing.

With a configuration according to the invention clearly improved cooling of the combustion engine arranged downstream of the starter is achieved since the cooling air inflow into the fan arranged behind the starter is improved and thus a favourable flow onto a magnet wheel can be achieved.

A further advantage of the use of a spring wound from wire whose cross-sectional areas substantially diminish from the second winding towards the other end is that the space required in the starter is also less.

According to the present invention it is not necessary that the spring is designed in circular form and thus as a truncated cone, On the contrary, all possible wound shapes with tapering sectional areas such as for example truncated pyramids, truncated tetrahedrons etc. are conceivable. A truncated cone shape with elliptic cross-sectional areas or a truncated pyramid shape with polygonal cross-sectional areas would also be conceivable.

According to a preferred embodiment the wound spring is a tapering coil spring. Such coil springs are easily available commercially and cost-effectively.

Particularly good progression characteristics of the spring can be achieved if the ratio of diameter and length meter on a base area and a top area of the spring amounts to 0.9 or less, preferentially 0.8 to 0.70 and particularly preferred approximately 0.75.

Preferentially the wire diameter of the spring is in the range from 2.5 to 3 mm and according to a further preferred embodiment amounts to approximately 2.8 mm.

Commercially available spring steel can be used as material for the spring. However, it would also be quite conceivable that a copper-tin alloy is used. In addition, the material could also have a coating.

Figure 2:
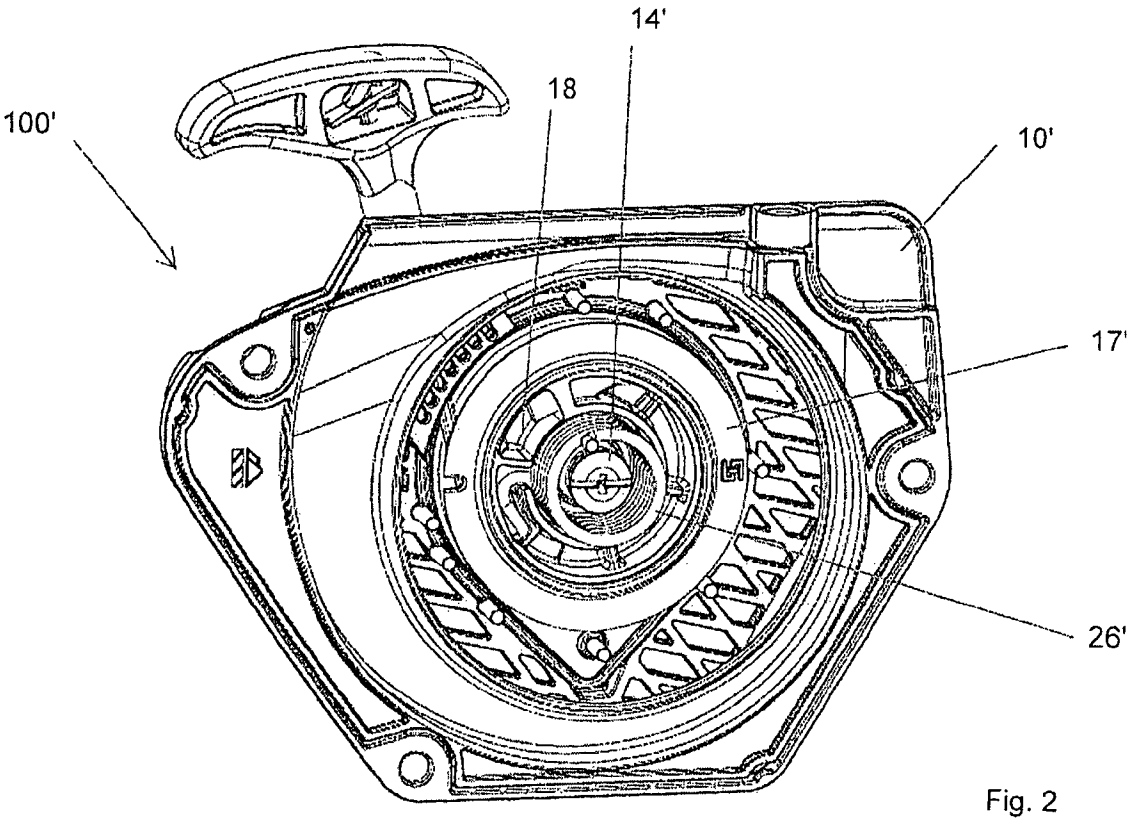
Fig. 2 PRIOR ART
Figure 3:
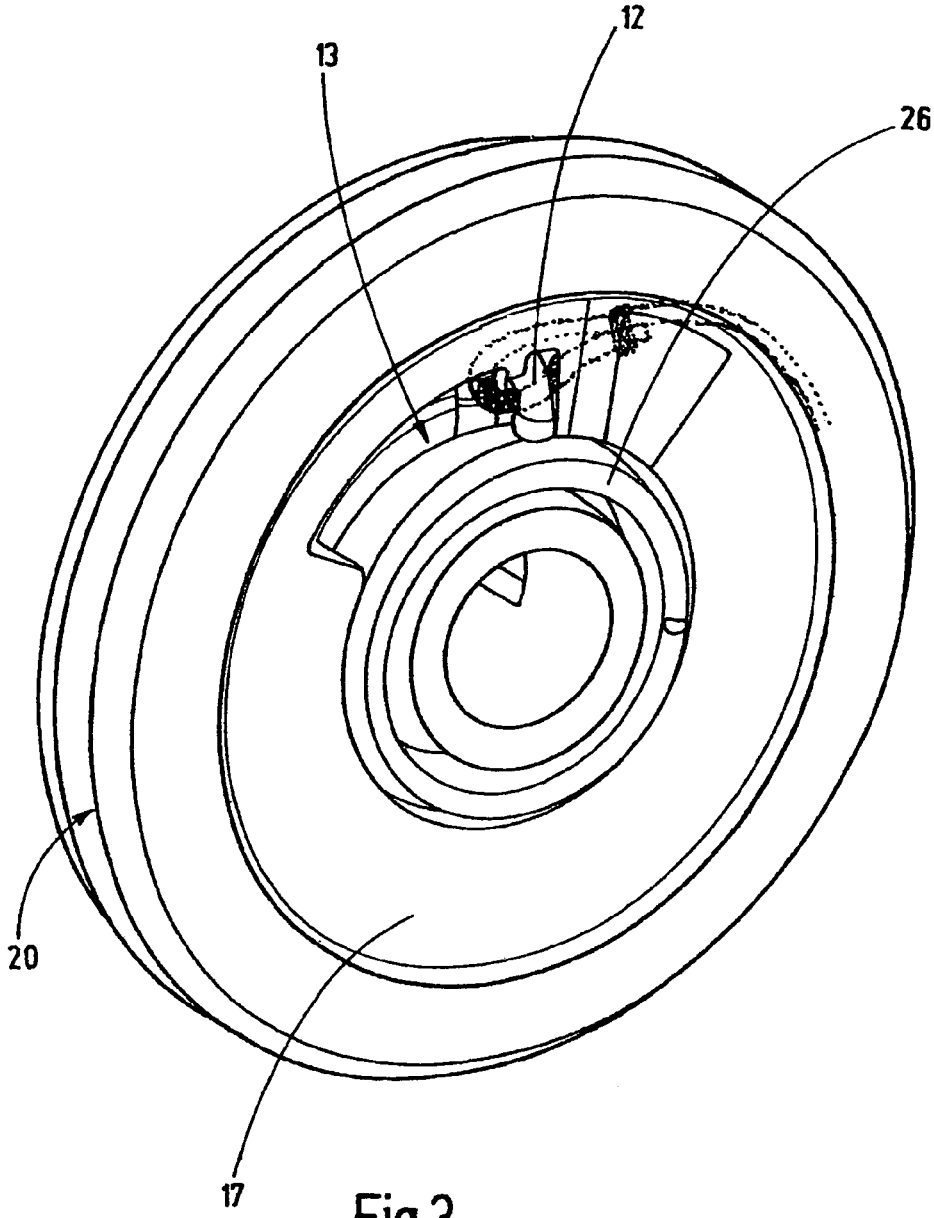
Figure 4:
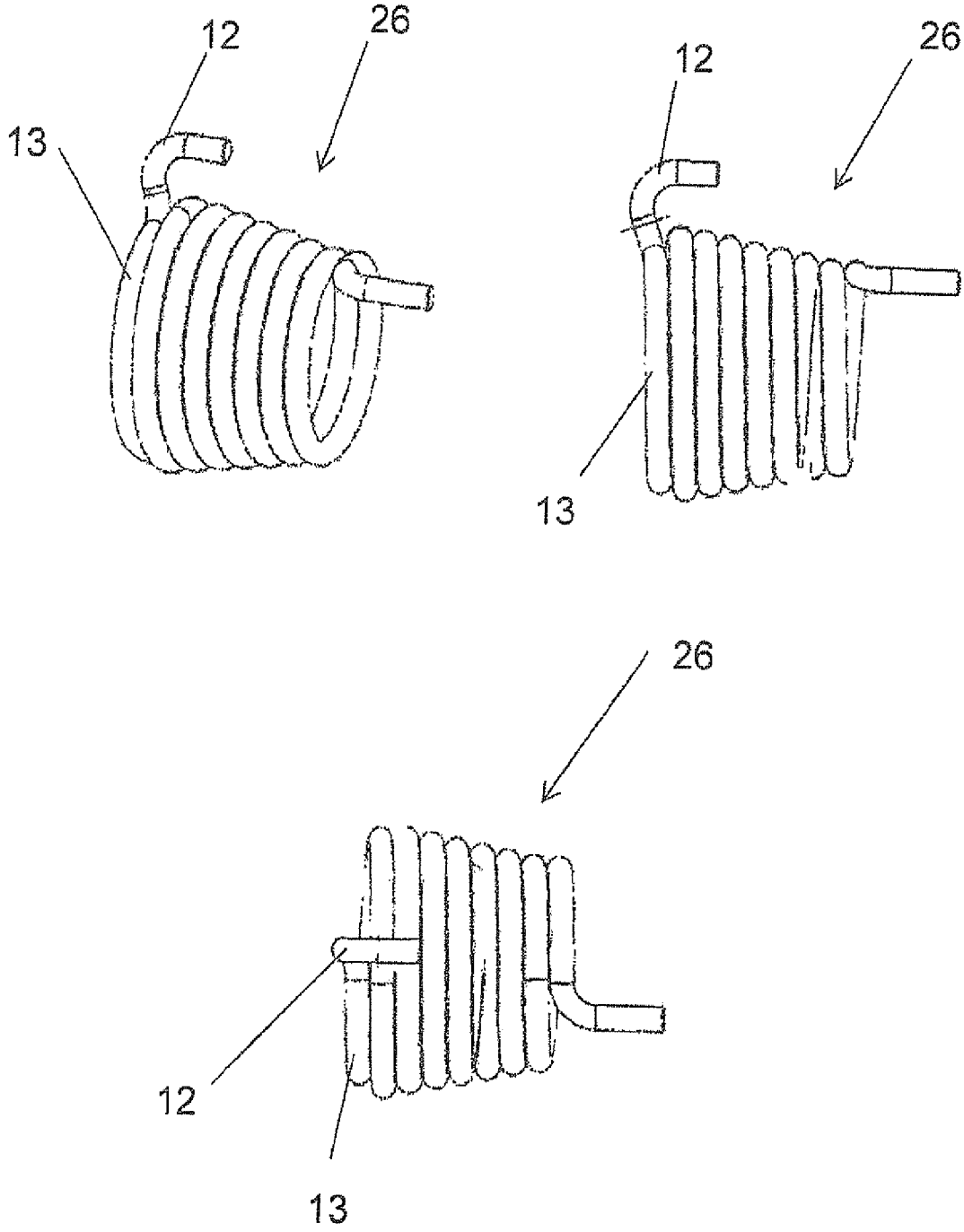

An exemplary embodiment of the invention is explained in more detail in the following by means of the drawing. Here it shows FIG. 1 a schematic exploded view of a starting device according to the prior art;

FIG. 2 a schematic view of a starting device according to the prior art;

FIG. 3 a schematic view of a starting device according to a preferred embodiment; and FIG. 4 three different views of a coupling element according to a preferred embodiment of the invention.

In the views of the prior art and the shown embodiment corresponding elements are designated with the same reference characters while the reference characters of the prior art are provided with an apostrophe.

FIG. 1 and FIG. 2 show a starting device 100' as is known from the prior art. Such a starting device 100', like the starting device 100 shown in FIG. 3, is intended for the manual starting of a combustion engine for example belonging to a power chain saw. The cable-operated starting device 100, 100' is accommodated in a housing 10, 10' which with the version according to the prior art (FIGS. 1 and 2) also is a removable lid of the engine housing provided with ventilation slots 11'. From the inner wall of the housing wall 10, 10' a bearing pin 14' emerges (visible only in FIGS. 1 and 2) which is surrounded by a likewise substantially housing-fixed spring housing 15' for a coil-shaped starter spring 16' clamped in on one end at the edge of the spring housing 15'. This starter spring 16' serves as return spring for the cable disc or cable drum 17, 17'.

On to the cable disc or cable drum 17, 17' a starter cable or pulling cable (not shown) is wound as force transmission means whose free end is led out of the housing 10, 10' and fastened to a handle. By pulling the starter cable by means of the handle the cable disc or cable drum 17, 17' is put in motion about the bearing pin 14' subject to the unwinding of the starter cable or pulling cable. The cable disc or cable drum 17, 17' comprises a circular mounting space 20/20' surrounding the bearing pin 14' in which a coil spring 26/26' is arranged which is engaged with a pawl driver link 25'.

The outer end, that is the end of the coil spring 26, 26' facing the cable disc or cable drum 17, 17' according to the representation of the prior art is hooked into a slot 27' which is provided in a ring-shaped shoulder of the cable disc or cable drum 17'. This shoulder encloses the coil spring 26' whose outer winding contacts the inner wall of the shoulder. The end of the coil spring 26' facing the pawl driver link 25' is mounted in the pawl driver link 25'.

In the mounted state of the starting device 100 the housing-fixed bearing pin 14' penetrates a centre bore of the face wall of the cable disc or cable drum 17, 17' so that this centre bore forms a bush-shaped mounting for the bearing pin 14'. A fastening screw (28) whose head is fastened to the pawl driver link 25, 25' is screwed into an axial internal thread of the bearing pin 14'.

When the cable disc or cable drum 17' according to the embodiment of the prior art is rotated by pulling the starter cable or pulling cable the cable disc or cable drum 17' drives the pawl driver link 25' via the coil spring 26'. By means of this pawl driver link 25' the rotary motion of the cable disc or cable drum 17' and thus the rotational moment can thus be transmitted to the engine shaft to be driven.

The coil spring 26', as shown in FIG. 1 according to the prior art, constitutes a cylindrical coil spring and the pawl driver link 25' is thus configured accordingly.

In contrast with the embodiment shown in FIGS. 1 and 2 according to the prior art the coil spring 26 in FIG. 3 according to a shown preferred embodiment of the present invention is integrated in the cable disc or cable drum 17 in such a manner that an end of the pulling cable for example is passed through a bore in the cable disc or cable drum 17 to the coil spring 26 and fastened to the latter on a hook 12 of the coil spring 26 in the knot chamber 18. In a very simple embodiment this could be effected for example by placing a knot in the pulling cable while the hook 12 to this end is advantageously embodied as an eye.

Furthermore, the coil spring, according to the embodiment shown in FIGS. 3 and 4, is configured in such a manner that the first winding 13 facing the cable disc or cable drum 17 has a smaller cross-sectional area than a following winding. This smaller spring winding 13 prevents breakage which, if at all, mainly occurs at this point in that under load it first comes to bear against the pin protruding into the spring 26.

From the second winding on, the spring 26 is configured as truncated cone whose base area faces the cable disc or cable drum 17 while the top area faces the pawl driver link 25.

A coil spring 26 thus configured results in clearly improved ventilation behaviour of the combustion engine since the inflow of the cooling air through the starting device 100 in the air guide 12 arranged after the starting device is improved since the conical spring 26 follows the inflowing cooling air flow and thus positively guides the cooling air flow.

LIST OF REFERENCE CHARACTERS

100/100' Starting device
10/10' Housing
11' Ventilation slots
12 Hook
14' Bearing pin
15/15' Spring housing
16/16' Starter spring
17/17' Cable disc or cable drum
18 Knot chamber
20' Mounting space of cable disc or cable drum
25' Pawl driver link
26/26' Coil spring
28' Fastening screw

The invention claimed is:

1. A starting device for at least one combustion engine, the starting device comprising: a cable-operated starting device for at least one two-stroke or four-stroke engine, with a cable drum rotatably mounted in a housing, the cable drum is operated for generating a drive rotational moment for an engine shaft and the cable drum can be rotated by means of at least one starting handle via at least one force transmission means and via at least one elastic coupling link which is connected with at least one driver link by means of which the drive rotational moment can be transmitted to the engine shaft, and whereas the coupling link has two ends, wherein a first end is engaged with the driver link, wherein a second end of the coupling link is engaged with the cable drum and the force transmission means in such a way that the force transmission means is guided by the cable drum and hinged on the coupling link, so that the force transmission means is attached to the coupling link.

2. The starting device according to claim 1,wherein a wire diameter of the spring is in the range from 2.5 to 3 mm, preferentially amounts to approximately 2.8 mm.

3. The starting device according to claim 1, wherein the coupling link comprises a three dimensional spring wound from wire whose first winding facing the cable disc or cable drum has a smaller cross-sectional area than a following winding.

4. The starting device according to claim 1, wherein the cross-sectional areas of the spring substantially diminish from the second winding facing the cable disc or cable drum to the end facing the driver link.

5. The starting device according to claim 1, wherein the wound spring from the second winding facing the cable disc or cable drum has a truncated cone shape with round and/or elliptic cross-sectional areas or a truncated pyramid shape with square of polygonal cross-sectional areas.

6. The starting device according to claim 1, wherein the wound spring from the second winding facing the cable disc or cable drum is a tapering coil spring.

7. The starting device according to claim 1, wherein a ratio of diameter and length meter from the first to the second winding facing the cable disc or cable drum of the wound spring amounts to 0.9 or less.

8. The starting device according to claim 1, wherein the ratio of diameter and length meter is in the range from 0.8 to 0.70 preferentially amounts to approximately 0.75.

* * * * *